US005483874A

United States Patent [19]

Shimizu et al.

[11] Patent Number: 5,483,874

[45] Date of Patent: Jan. 16, 1996

[54] ELECTROPRESSING APPARATUS WITH COMPUTER PROGRAMMABLE CONTROL

[75] Inventors: Masato Shimizu; Fumiaki Kobayashi; Yoshio Akahori; Shinichi Fukada, all of Tokyo, Japan

[73] Assignee: Janome Sewing Machine Co., Ltd., Tokyo, Japan

[21] Appl. No.: 210,399

[22] Filed: Mar. 18, 1994

[51] Int. Cl.[6] ..... B30B 15/14

[52] U.S. Cl. ..... 100/50; 100/256; 100/289

[58] Field of Search ..... 100/43, 48, 50, 100/52, 53, 256, 289

[56] References Cited

U.S. PATENT DOCUMENTS

| | | | |
|---|---|---|---|
| 1,232,711 | 7/1917 | Mueller | 100/256 |
| 2,164,245 | 6/1939 | Kienzle | 100/256 |
| 5,086,965 | 2/1992 | Marsteller et al. | 100/53 |
| 5,115,735 | 5/1992 | Gloe et al. | 100/43 |

FOREIGN PATENT DOCUMENTS

| | | | |
|---|---|---|---|
| 0536804 | 4/1993 | European Pat. Off. | 100/48 |
| 5-329691 | 12/1993 | Japan . | |
| 5-329690 | 12/1993 | Japan | 100/289 |

*Primary Examiner*—Stephen F. Gerrity
*Attorney, Agent, or Firm*—Lowe, Price, LeBlanc & Becker

[57] ABSTRACT

An electropressing apparatus includes an electric motor driven through a motor driver circuit to operate a pressing ram through a rotational mechanism constructed to move the pressing ram in a vertical direction relative the workpiece. Various detecting and control arrangements are used to detect, memorize, set and change the following: an initial position of the pressing ram; an upper limit stop position of the pressing ram with respect to the workpiece; a lower limit stop position of the pressing ram immediately above the workpiece; a position at which the pressing ram starts to apply a pressure to the workpiece; and a terminal position at which the pressing ram stops to apply pressure to the workpiece.

2 Claims, 6 Drawing Sheets

ELECTROPRESSING APPARATUS WITH COMPUTER PROGRAMMABLE CONTROL

BACKGROUND OF THE INVENTION

The invention relates to an electropressing apparatus and, more particularly, to an electropressing apparatus which is capable of pressing small workpieces with extremely high precision and efficiency.

Various pressing apparatus have been proposed for pressing workpieces, including a mechanical power press, a foot power press, a liquid power press, an air power press and the like all of which have specific uses. These presses are generally large sized for pressing comparatively large sized workpieces and are not adapted for precision pressing of comparatively small sized workpieces.

SUMMARY OF THE INVENTION

It is therefore an object of the invention to provide an electropressing apparatus which is especially adapted to press workpieces of smaller types.

It is another object of the invention to provide an electropressing apparatus which is structurally compact and rapidly operative with respect to a workpiece to be pressed.

It is still another object of the invention to provide an electropressing apparatus including a vertically moving pressing ram, the vertical position of which is controlled with required speeds and pressures each designated by a central processing unit (CPU).

The invention satisfies the foregoing objects and eliminates the defects and disadvantages of the prior art through an electropressing apparatus which is structurally compact and rapidly operable with both high precision and efficiency to press workpieces of smaller types. In the apparatus of the invention an electric main drive motor rotates a threaded drive shaft that drives a pressing ram in a vertical direction, the vertical positions of which are controlled with required speeds and pressures each designated by a central processing unit (CPU) with respect to workpieces to be pressed.

An electropressing apparatus comprises drive means including an electric motor and motor driver means including a motor driver circuit for driving the electric motor. Pressing means is operatively connected to the electric motor for driving movement, and includes a pressing ram and a rotational mechanism operatively connected to the pressing ram and to the electric motor to be rotated thereby. The rotational mechanism is constructed to move the pressing ram in vertical directions with reference to a workpiece to be pressed. First control means is provided for setting, memorizing and detecting an initial position of the pressing ram. Second control means sets, memorizes, detects and changes an upper limit stop position of the pressing ram with respect to the workpiece. Third control means is provided for setting, memorizing, detecting and changing a lower stop position of the pressing ram immediately above the workpiece, with fourth control means provided for setting, memorizing, detecting and changing a position at which the pressing ram starts to apply pressure to the workpiece. Fifth control means is used for setting, memorizing, detecting and changing a terminal position at which the pressing ram stops applying pressure to the workpiece.

The electropressing apparatus further comprises sixth control means for setting, memorizing, detecting and changing a pressure to be applied to the workpiece by the ram.

DETAILED DESCRIPTION OF THE PREFERRED EMBODIMENT

Figure 5:
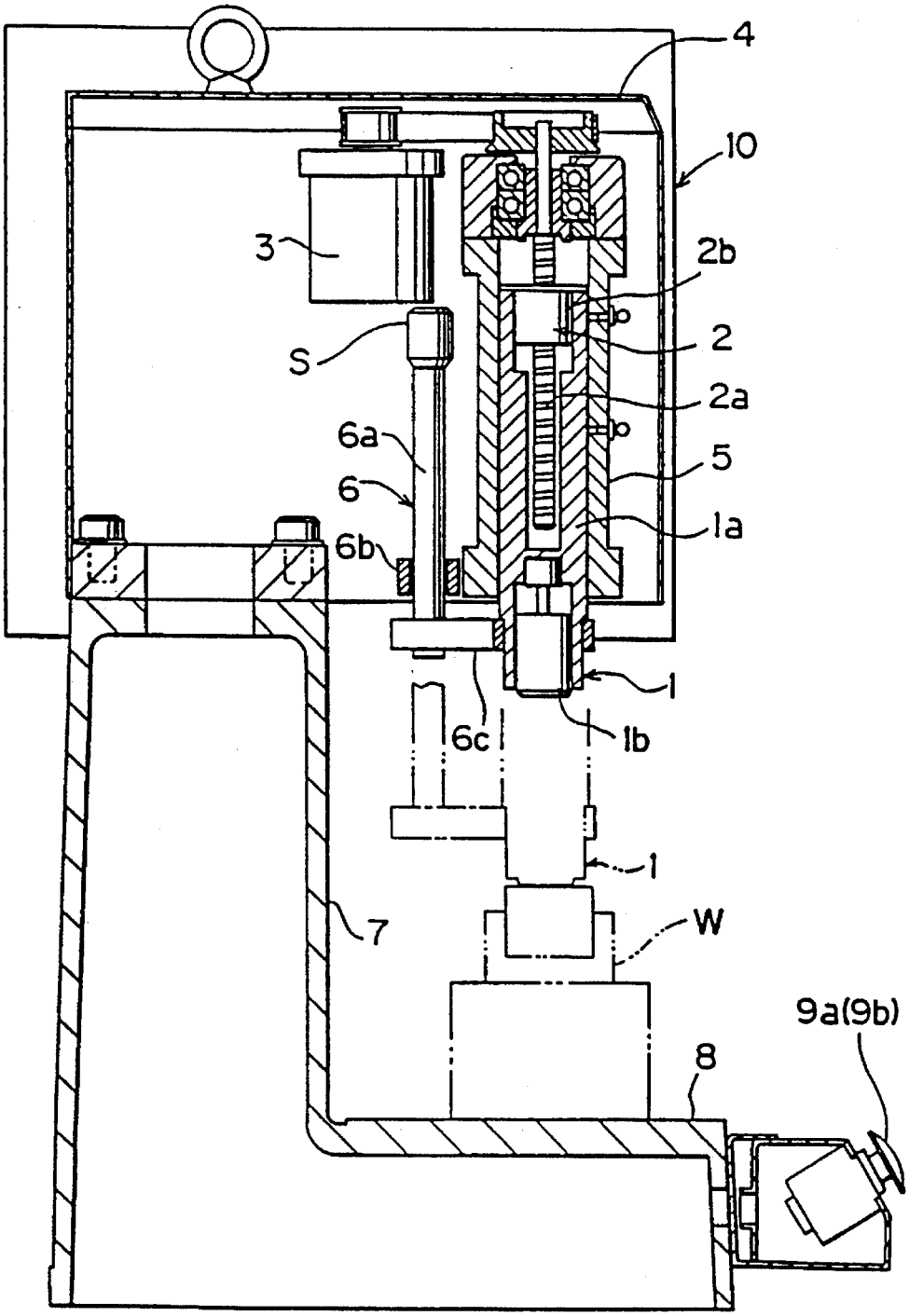
FIG. 5 is a side elevational view of an electropressing apparatus of the invention in vertical section.
Figure 6:
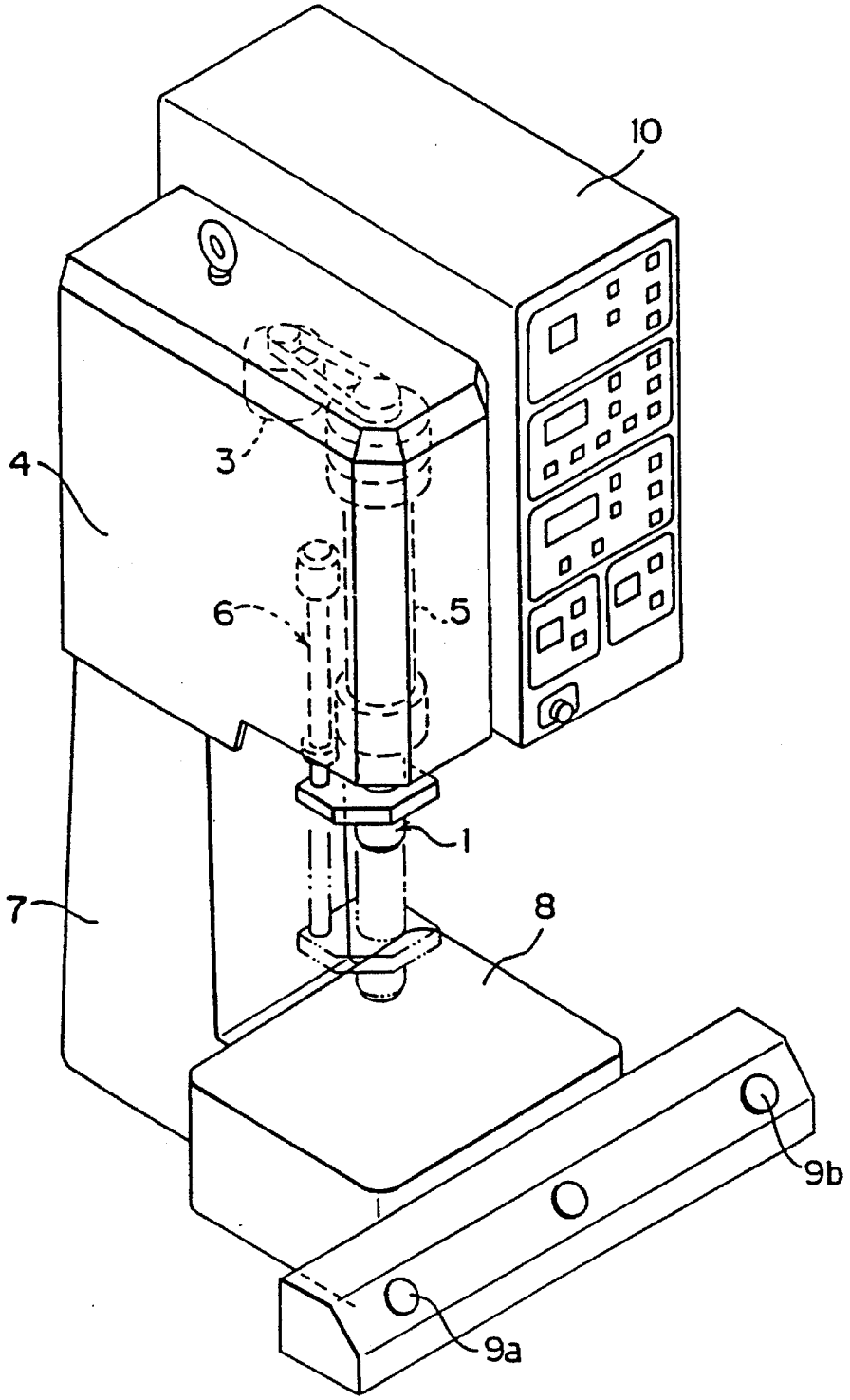
FIG. 6 is a perspective view of the electropressing apparatus.

A preferred embodiment is depicted in FIGS. 5 and 6, wherein an electropressing apparatus of the invention comprises a pressing ram 1 which is vertically movable to import a desired pressure to a workpiece W through a threaded ball-bearing drive shaft 2 which is rotated by an electric drive motor 3. The aforementioned components are placed in an upper frame 4 of a casing.

The pressing ram 1 is formed in a ram cylinder 1*a* having a hollow axially extending passage designed to axially receive therein the threaded ball-bearing drive shaft 2 which is composed of a threaded drive shaft 2*a* and a nut block 2*b* in threaded engagement with the shaft 2*a* through plural ball-bearings (not shown) arranged in fitted engagement with the threads between the threaded drive shaft 2*a* and the nut block 2*b*. The hollow passage is diametrically enlarged at an upper part which receives therein the nut block 2*b* to enable the nut block to be secured to the upper end of the cylinder 1*a*.

The upper end part of the threaded drive shaft 2*a* is journalled in a bearing in the upper frame 4 and operatively connected to the electric drive motor 3 by means of a transmission belt. The rotational movement of the threaded drive shaft 2*a* is transmitted to the nut block 2*b* through the ball-bearings. As the result, the nut block 2*b* is moved axially by the threaded drive shaft 2*a*. Ram cylinder 1*a* moves axially with the nut block 2*b* relative to the workpiece W.

The ram cylinder 1*a* has a press member 1*b* detachably mounted to the lower end to import a desired pressure to the workpiece W as the cylinder moves vertically downward. The press member 1*b* may have a strain gauge mounted thereon for detecting a pressure imported to the workpiece W.

The ram cylinder 1*a* is received within a cylindrical guide 5 fixed arranged in the upper frame 4 so that the ram cylinder 1*a* may be vertically slidably moved along an inner peripheral wall of the cylindrical guide 5.

Another guide 6 is mounted adjacent the cylindrical guide 5 to prevent ram cylinder 1*a* from rotating in a plane normal to the axis of ram cylinder 1*a*. Guide 6 includes a vertical guide shaft 6*a* extending parallel to the cylindrical guide 5. A guide member 6*b* is fixed to the upper frame 4 in sliding engagement with the guide shaft 6*a* to guide the vertical movement of the guide shaft 6*a* as well as a connecting member 6*c* having one end secured to the lower end part of the ram cylinder 1*a* and extending laterally in a plane normal to the axis of the ram cylinder for connection of its other end to the lower end of the guide shaft 6*a*. In this manner, guide shaft 6*a* vertically moves with the ram cylinder 1*a* while preventing rotation of the ram cylinder within the cylindrical guide 5.

Figure 3:
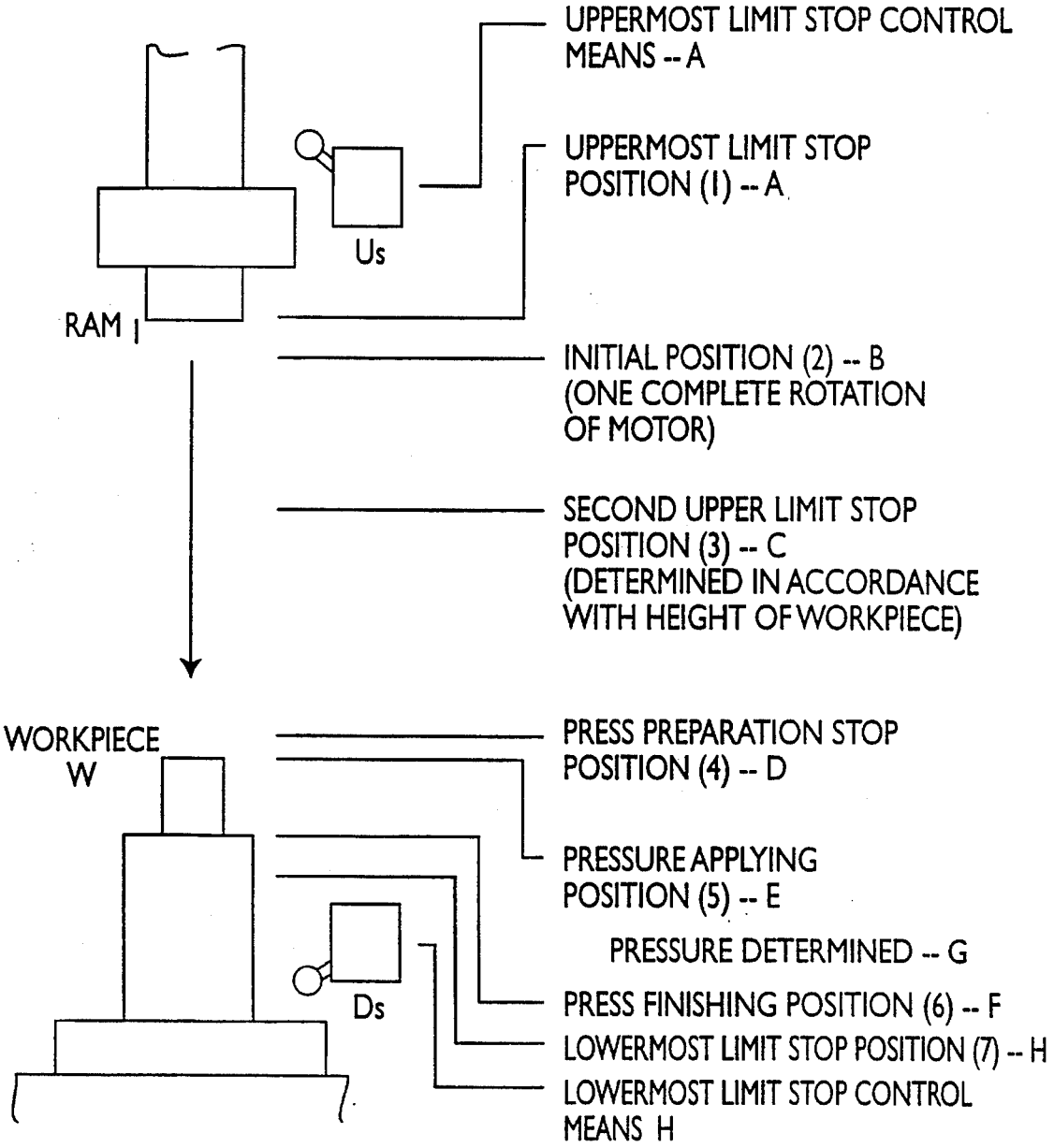
FIG. 3 is an explanatory view of the invention showing the positions of a pressing ram to be controlled with reference to a workpiece to be pressed.

With reference to FIGS. 3 and 5, the guide shaft 6*a* has a diametrically enlarged head S formed at the upper end thereof. The head S is designed to sequentially engage and operate an upper switch Us and a lower switch Ds, as depicted in FIG. 3, during vertical movement of the ram cylinder 1*a* to thereby determine the stroke length of the ram cylinder 1*a* (i.e., the limits of upper and lower movement).

Figure 1:
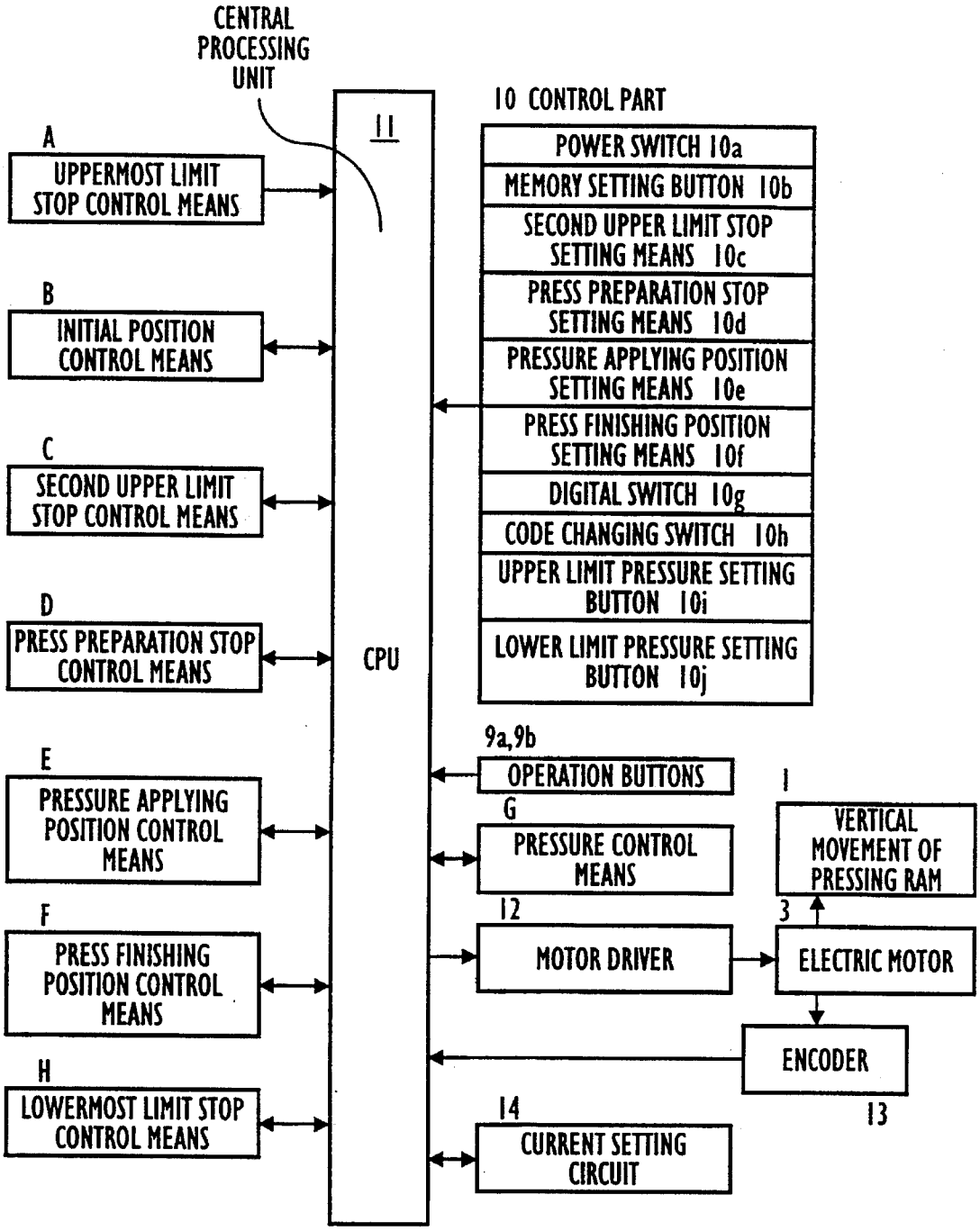
FIG. 1 is a block diagram of a control system according to the invention.
Figure 2:
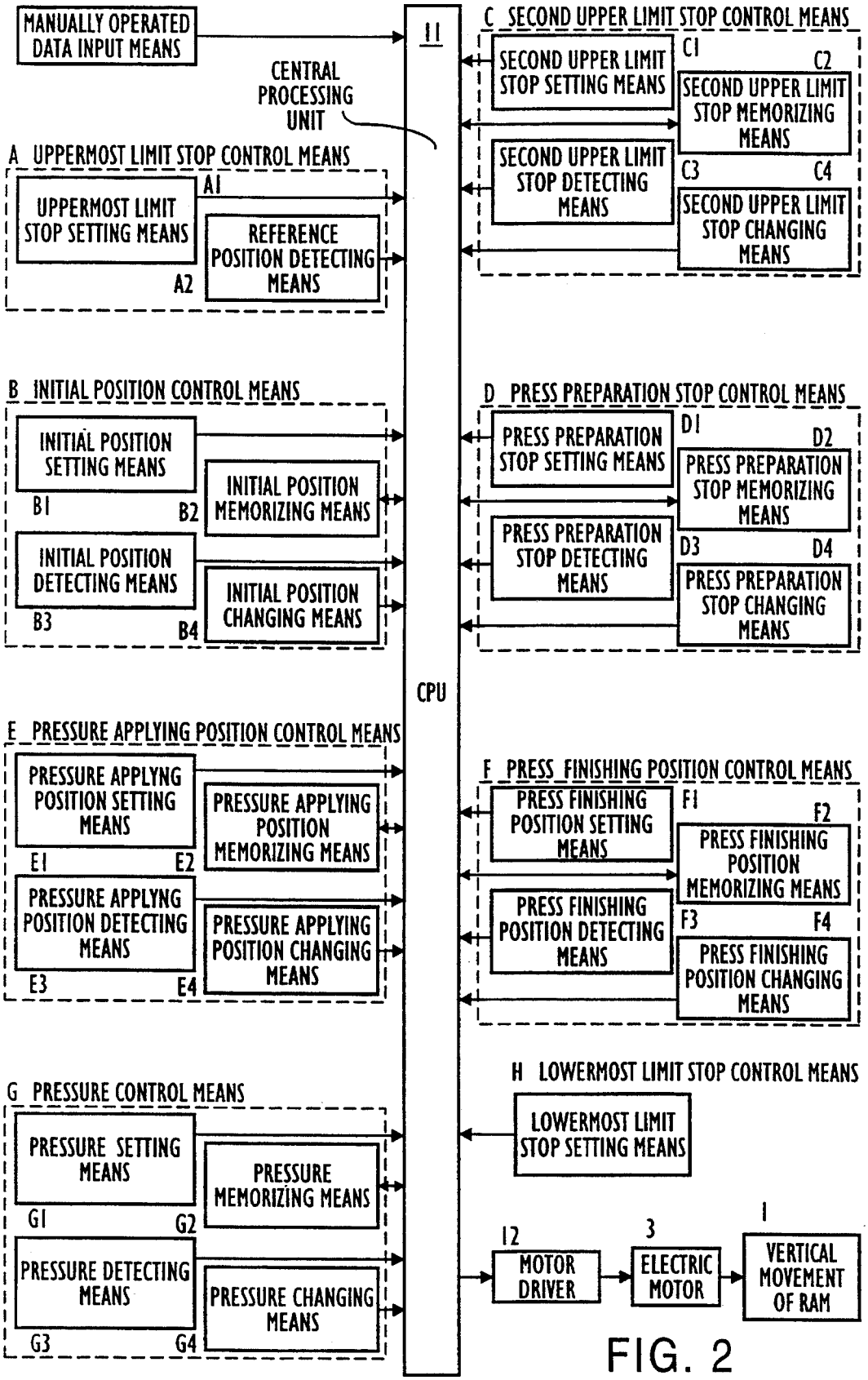
FIG. 2 is a detailed block diagram of the control system of FIG. 1.

With reference to FIGS. 1, 3 and 5, the upper switch Us produces an operation signal when contacted by the head S during upward movement of the guide shaft 6*a*. The operation signal is transmitted to a central processing unit (CPU) 11. The CPU 11 is responsive to the operation signal to signal a motor driver 12 to stop electric motor 3, and thereby prevent further lifting movement of the ram cylinder 1*a*, thus preventing the nut block 2*b* from striking the upper bearing. In a similar manner, lower switch Ds is operated by the head S while the guide shaft 6*a* lowers to produce an operation signal. The CPU 11 is responsive to this operation signal to signal motor driver 12 to stop electric motor 3, and thereby halt further lowering movement of the ram cylinder 1*a*, preventing the nut block 2*b* from threaded disengagement with the drive shaft 2*a*.

in FIGS. 1, 2 and 3, the upper switch Us is represented as an upper limit control means A for the movement of the pressing ram 1, and is further represented as comprising a means A1 for setting an upper limit (1) and a mean A2 for detecting a reference position of the pressing ram 1. The lower switch Ds is represented as a lower limit control means H for the lower movement of the pressing ram 1 and further represented as comprising a means H for setting a lower limit (7).

With reference to FIG. 6, the electropressing apparatus is provided with a lower bed 8 on which the workpiece W is to be placed below the pressing ram 1. A standard 7 located to one side end of the lower bed 8 supports the upper frame 4 at an upper end thereof. The lower bed 8 has a front side part provided with operation buttons 9*a* and 9*b* which are simultaneously pressed to lower the pressing ram 1. The lower movement of the pressing ram 1 is stopped when the button 9*b* is released while button 9*a* continues to be pressed. The pressing ram 1 is raised when the buttons 9*a* and 9*b* are released at the same time. A control part 10 provided on one side of the upper frame 4 includes a plurality of operation switches and buttons 10*a*–10*j* as shown in FIG. 1.

The switch 10*a* is operated to supply electric power to the electropressing apparatus. The button 10*b* is operated to set various data stored in a memory. The button 10*c* sets an upper movement distance of the pressing ram 1 with reference to a variable height of the workpiece W, while button 10*d* sets a position at which the pressing ram 1 stops immediately before applying pressure to the workpiece W. The button 10*e* is operated to start to apply a pressure to the workpiece W. The button 10*f* is operated to stop applying a pressure to the workpiece W. The switch 10*g* is a digital switch used as a code generator and is operated to adjust predetermined stop positions of the pressing ram 1. In practice, the digital switch 10*g* is operated to set an adjusting value and then code changing switch 10*h* is operated to designate addition or subtraction values. The CPU 11 is then operated to make a calculation for changing a position previously set by the button 10*d*. The button 10*i* is operated to set a maximum pressure to be applied to the workpiece W, and the button 10*j* is operated to set a minimum pressure.

The CPU 11 stores therein an initial position (2) of the pressing ram 1, upper positions (3) to be set with reference to a variable height of the workpiece W, a position at which the moving speed of the pressing ram 1 is switched from acceleration to deceleration or vice versa, a position at which a set pressure is generated, and a position at which the pressing ram 1 is stopped. The CPU 11 detects when pressing ram 1 reaches these positions as mentioned above and produces instructions for changing the rotation speed of the electric motor 3, the amperage to be supplied to the motor 3 and for turning on and off power supplied to the motor 3 and for reversing the rotation of the motor 3.

The motor driver 121 is operated by the signal of the CPU 11 to drive the electric motor 3. As an element for detecting the reference position of the pressing ram 1, an encoder 13 is connected to the electric motor 3 to detect a moving amount and the speed of the pressing ram 1.

A current setting circuit 14 is responsive to a digital signal from the CPU 11 to change the digital signal into an analog signal supplied to the motor driver 12.

The pressing operation and the setting thereof will be described as follows. When power switch 10*a* is turned on, CPU 11 initially signals motor driver 12 to raise the pressing ram 1. As the pressing ram 1 moves up, the head S of the guide shaft 6*a* engages the upper switch Us to operate the same. The upper switch Us is then operated to detect the upper limit position (1) of the pressing ram 1 and produces an upper limit detecting signal.

The CPU 11 is operated in response to the upper limit detecting signal and stops the motor 3 and then reverses the rotation of the motor 3 to move down the same by a distance corresponding to a number of pulses stored in the CPU 11 while the number of pulses are confirmed by the encoder 13. When the number of pulses are reached, the CPU 11 will stop the motor 3 to thereby determine the initial position (2) of the pressing ram 1. In this connection, an initial position control means B comprises means B1 for setting the initial position (2) of the pressing ram 1; memory means B2 for storing therein the set initial position (2) of the pressing ram 1; detecting means B2 including the encoder 13 for detecting the set initial position; and means B4 for changing the set initial position. The pressing ram 1 is operated in reference to the initial position.

The memory setting button 10*b* is then operated to set one of the required pressing modes and the corresponding memorizing mode. The operation buttons 9*a* and 9*b* are then simultaneously pressed to lower the pressing ram 1. In the meantime, the operation button 9*b* is released while the other button is kept pressed to temporarily stop the pressing ram 1 at a desired position with reference to the height of the workpiece W to be pressed. Next, the button 10*c* is pressed to memorize the stopped position of pressing ram 1 within the CPU 11 as a height setting position (3). Thus the pressing ram 1 will not move up beyond the height setting position in repeated pressing operations as to a specific workpiece W. Namely, the stroke of the pressing ram 1 is minimized in accordance with the height of the workpiece W. In this connection, a height setting control means C comprises means C1 for setting the upper position of the pressing ram 1 with respect to the workpiece W; memory means C2 for memorizing therein the set upper position; means C3 for detecting the set upper position; and means C4 for changing the set upper position.

The operation buttons 9a and 9b are simultaneously pressed again to lower the pressing ram 1 until it reaches a position (4) immediately above a position where the pressing ram 1 applies pressure to the workpiece W (approximately 1 mm above the workpiece W). Operation button 9b is then released while the other operation button 9a remains pressed to stop the pressing ram 1 at the position again. Button 10d is then pressed to memorize the stopped position in the CPU 11. In this connection, a stop position control means D comprises means D1 for setting the stop position (4); means D2 for memorizing the set stop position in the CPU 11; means D3 for detecting the set stop position; and means D4 for changing the set stop position.

Operation buttons 9a and 9b are once again simultaneously pressed to lower the pressing ram 1. In the meantime, with confirmation of the set stop position (4) by the encoder 13, the CPU 11 is operated to activate a switch 10e to set and memorize a press starting position (5) at which a required pressure is applied to the workpiece W. In this connection, a press starting position control means E4 comprises means E1 for setting the press starting position; means E2 for memorizing therein the press starting position; means E3 for detecting the press starting position; and means E4 for changing the press starting position.

The pressing ram 1 continues to be lowered while the operation buttons 9a and 9b are simultaneously pressed until the pressing ram reaches a position (6) where the pressing ram 1 has completely pressed the workpiece W, and then is stopped. A button 10f is then operated to memorize the press finishing position (6) in the CPU 11. In this connection, a press finishing position control means F comprises means F1 for setting the press finishing position (6); means F2 for memorizing the press finishing position; means F3 for detecting the press finishing position; and means F4 for changing the press finishing position.

When pressing ram 1 reaches press finishing position (6), motor 3 is automatically rotated in the opposite direction to raise the pressing ram to the upper stop position (3).

According to the invention, pressing ram 1 is programmed to descend at a high speed from upper stop position (3) to lower stop position (4) immediately above the press starting position (5). The pressing ram 1 is programmed to then lower at a slower speed from the lower stop position (4) to the press starting position (5) and stop temporarily thereat. The pressing ram 1 is programmed to move down at a lower speed with a required level of pressure from the press starting position (5) to the press finishing position (6).

In order to make the press finishing position control means F practically effective, pressure control means G is soften employed for controlling a pressure applied to the workpiece W. In this connection, the pressure control means G comprises means G1 for setting a pressure to be applied to the workpiece W; means G2 for memorizing therein the set pressure; means for detecting the set pressure; and means G4 for changing the set pressure.

The press finishing position (6) may be set by a press distance control means. Further the press finishing position may be changed as required by setting the digital switch 10g with an adjusting value.

The CPU 11 is operated under a predetermined program to produce digital instruction signals which are converted into analog current values through the current setting circuit 14 and sent to the motor driver 12 for controlling the operations of the electropressing apparatus.

According to the invention, the press starting position (5) may not be previously set. In other words, when the pressing ram 1 moves down to the set stop position (4) immediately above the press starting position (5), the CPU 11 will generate an instruction signal for supplying a minimum amount of power to the motor 3 to simply move down the pressing ram at a lower speed such that the pressing ram 1 will stop due to the resistance of the workpiece W at the press starting position (5). Following confirmation of pressing ram stoppage by encoder 13, the CPU 11 will supply a gradually increasing amount of power to the motor 3 and move the pressing ram 1 with a predetermined set pressure until the pressing ram 1 comes down to the press finishing position (6). The CPU 11 will stop motor 3 for a predetermined period of time, and will then rotate the motor 3 to raise pressing ram 1 to the upper set position (3).

Figure 4:
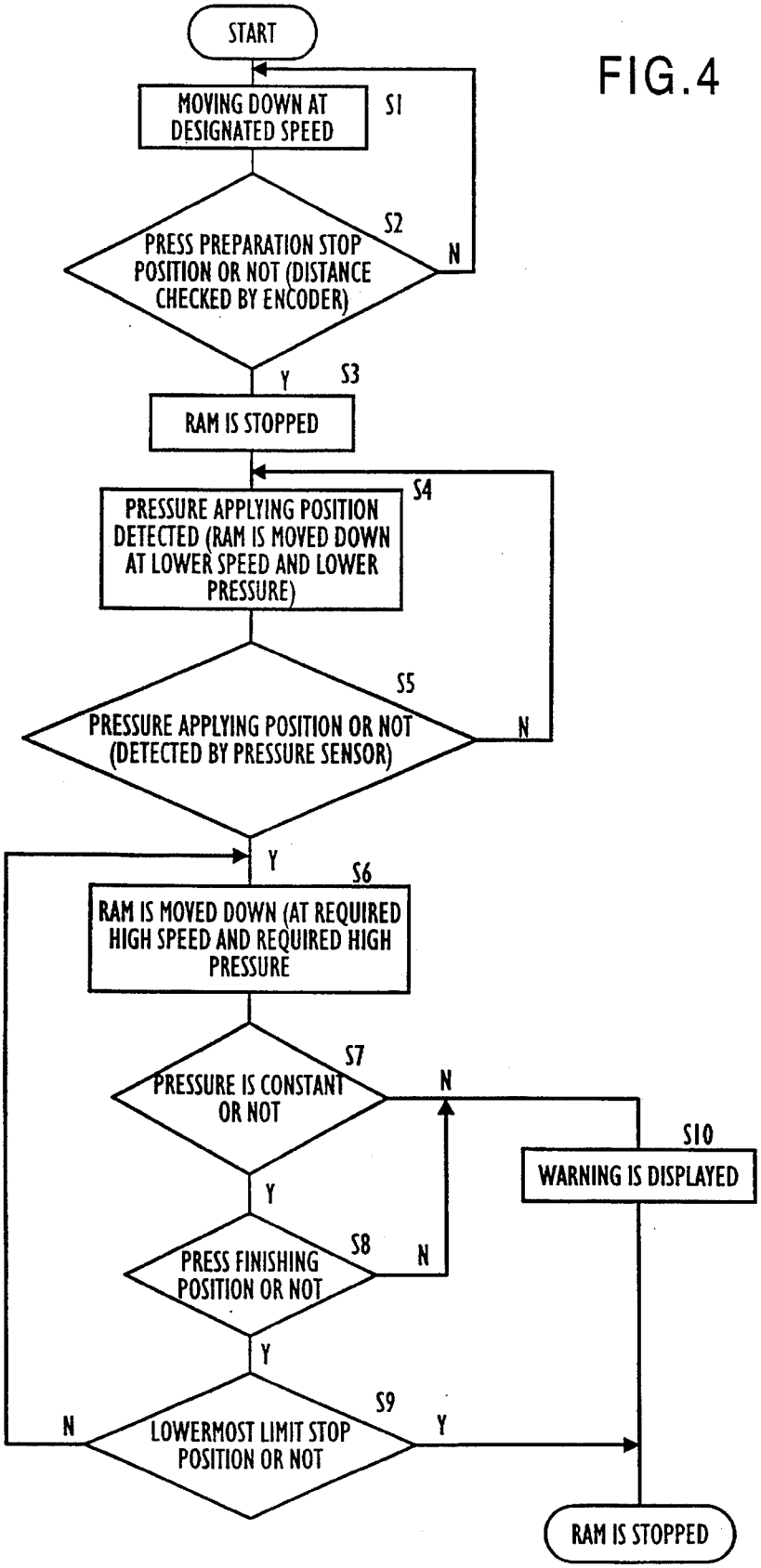
FIG. 4 is a flow chart depicting a series of programmed operations according to the invention.

A flow chart depicted in FIG. 4 embodying the essential features of work pressing operations according to the invention will now be described:

When the program starts, the pressing ram 1 will be lowered at S1 from upper set position (3) at a designated high speed.

At S2, the program determines whether pressing ram 1 has reached position (4) immediately above press starting position (5).

If the discrimination result is N(No), the program returns to START and the pressing ram 1 continues to lower.

If the discrimination result is Y(Yes), the pressing ram 1 is stopped at S3 and then lowered from S3 at a predetermined lower speed and with a predetermined lower pressure through a step S4.

At S5, the program determines with a pressure sensor whether the pressing ram 1 has reached press starting position (5).

If the discrimination result is N, the program is returned to S3 and the pressing ram 1 continues to lower.

If the discrimination result is Y, the pressing ram 1 is moved down at a designated speed and with a designated high pressure at S6.

At S7, the program determines whether the designated pressure is constant.

If the discrimination result is N, a warning is displayed at S10 and the pressing ram 1 is stopped.

If the discrimination result is Y, the program determines at S8 whether the pressing ram 1 has reached press finishing position (6).

If the discrimination result is N, a warning is displayed at S10 and the pressing ram 1 is stopped.

If the discrimination result is Y, the program determines at S9 whether the pressing ram 1 has reached a lower stop position.

If the discrimination result is N, the program is returned to S6 and the pressing ram is moved down again.

If the discrimination result is Y, the pressing ram is stopped.

Thus the sequential steps of pressing operations are finished and then the pressing ram 1 is returned to the upper set position (3).

What is claimed is:

1. An electropressing apparatus for pressing a workpiece, comprising:

(a) an electric motor;

(b) motor driver means including a motor driving circuit for driving the electric motor;

(c) pressing means including a pressing ram and a rotational mechanism operatively connected to the pressing ram and electric motor for rotation by the motor to move the pressing ram in a vertical direction relative to the workpiece;

(d) first detecting means for detecting an initial position of the pressing ram, and first control means, communicating with the first detecting means for setting and memorizing the initial position of the pressing ram as detected by the first detecting means;

(e) second detecting means for detecting an upper limit stop position of the pressing ram relative to the workpiece, and second control means, communicating with said second detecting means, for setting, memorizing and changing said upper limit stop position;

(f) third detecting means for detecting a lower limit stop position of the pressing ram immediately above said workpiece, and third control means communicating with said third detecting means for setting, memorizing and changing said lower limit stop position;

(g) fourth detecting means for detecting application of pressure by the pressing ram against the workpiece, and fourth control means communicating with said fourth detecting means for setting, memorizing and changing a position at which the pressing ram starts to apply pressure to the workpiece; and (h) fifth detecting means for detecting a terminal position at which the pressing ram stops and begins to apply increasing pressure against the workpiece, and fifth control means communicating with said fifth detecting means for setting, memorizing and changing said terminal position.

2. The electropressing apparatus of claim 1, further comprising sixth detecting means for detecting pressure applied to the workpiece by the pressing ram, and sixth control means communicating with said sixth detecting means for setting, memorizing and changing said pressure applied to the workpiece by the pressing ram.

* * * * *